US010312576B2

(12) United States Patent
DeBusk et al.

(10) Patent No.: US 10,312,576 B2
(45) Date of Patent: Jun. 4, 2019

(54) QUICK MOUNT DETACHABLE ANTENNA AND MOUNTING

(71) Applicant: FreeFlight Acquisition Corporation, Irving, TX (US)

(72) Inventors: John DeBusk, Southlake, TX (US); Behlul Poonawalla, Flower Mound, TX (US)

(73) Assignee: FREEFLIGHT ACQUISITION CORPORATION, Irving, TX (US)

( * ) Notice: Subject to any disclaimer, the term of this patent is extended or adjusted under 35 U.S.C. 154(b) by 0 days.

(21) Appl. No.: 14/990,436

(22) Filed: Jan. 7, 2016

(65) Prior Publication Data

US 2016/0225268 A1 Aug. 4, 2016

Related U.S. Application Data

(60) Provisional application No. 62/100,795, filed on Jan. 7, 2015.

(51) Int. Cl.

| | |
|---|---|
| ***G08G 1/01*** | (2006.01) |
| ***H01Q 1/32*** | (2006.01) |
| ***H01Q 1/12*** | (2006.01) |
| ***H01Q 21/30*** | (2006.01) |
| *H01Q 9/32* | (2006.01) |

(52) U.S. Cl.

CPC ..... *H01Q 1/3233* (2013.01); *H01Q 1/1207* (2013.01); *H01Q 21/30* (2013.01); *H01Q 9/32* (2013.01)

(58) Field of Classification Search

CPC .... H01Q 1/3233; H01Q 21/30; H01Q 1/1207; H01Q 9/32

USPC ..... 340/933, 568.1, 573.1, 990, 945, 961; 342/29, 30, 37, 357.31, 562.1, 357.4, 417; 455/67.11, 571, 7, 557, 101, 575.9, 575.1, 455/90.1

See application file for complete search history.

(56) References Cited

U.S. PATENT DOCUMENTS

| | | | | |
|---|---|---|---|---|
| 6,271,797 | B2 * | 8/2001 | Miller | H01Q 1/1207 343/713 |
| 6,288,684 | B1 * | 9/2001 | Wiggenhorn | H01Q 1/3275 335/288 |
| 2003/0040342 | A1 * | 2/2003 | Coan | H04B 7/18534 455/571 |
| 2009/0146875 | A1 * | 6/2009 | Hovey | G08G 5/04 342/357.31 |
| 2011/0279337 | A1 * | 11/2011 | Corwin | H01Q 1/088 343/713 |
| 2016/0329632 | A1 * | 11/2016 | Caratelli | H01Q 1/48 |

* cited by examiner

*Primary Examiner* — Dhaval V Patel
(74) *Attorney, Agent, or Firm* — Haynes & Boone, LLP

(57) ABSTRACT

An antenna system is disclosed. The antenna systems includes a base, a beam carried by the base, a global positioning system antenna carried near a first end of the beam, and a monopole antenna carried near a second end of the beam.

7 Claims, 3 Drawing Sheets

QUICK MOUNT DETACHABLE ANTENNA AND MOUNTING

CROSS REFERENCE TO RELATED APPLICATIONS

The present application claims priority to and the benefit of the U.S. Provisional Patent Application No. 62/100,795, filed Jan. 7, 2015, which is hereby incorporated by reference in its entirety.

FIELD

The present disclosure relates generally to avionics, and more specifically to Automatic Dependent Surveillance Broadcast (ADS-B) systems.

BACKGROUND

ADS-B is an aircraft surveillance and traffic management technology and system for enhancing situational awareness, in which location messages are sent periodically by aircraft without the need for interrogation from a ground station. The system is dependent on aircraft being equipped with high integrity position sources, such as Wide Area Augmentation System (WAAS) Global Positioning System (GPS) receivers. ADS-B provides real-time surveillance services to both Air Traffic Control stations and to appropriately equipped aircraft.

ADS-B makes use of two operating frequencies—978 MHz and 1090 Mhz: Aircraft may transmit position information (referred to as ADS-B OUT) at 1090 MHz using an Extended Squitter equipped transponder or, if limited to operating below flight level 180 (approximately 18,000 feet), at 978 MHz using Universal Access Transceiver (UAT). ADS-B OUT information may be directly received by other similarly-equipped aircraft and by ground stations within line-of-sight.

Aircraft may receive position information of other aircraft and about obstacles, as well as weather and other information (referred to as ADS-B IN). ADS-B equipped 1090 MHz aircraft may directly receive both position information from other ADS-B equipped 1090 MHz aircraft and Traffic Information Services Broadcasts (TIS-B) from ground stations. Similarly, ADS-B equipped 978 MHz aircraft may directly receive both position information from other ADS-B equipped 978 MHz aircraft and TIS-B from ground stations. TIS-B provides traffic and obstacle information within a cylindrical volume of airspace about the aircraft. TIS-B data includes self-reported position data from both 1090 MHz and 978 MHz ADS-B OUT equipped aircraft and basic position data from non-ADS-B OUT equipped aircraft within radar range of the ground station. Moreover, ADS-B equipped 978 MHz aircraft may receive Flight information Services Broadcasts (FIS-B) which includes subscription-free graphical and textual weather data. Due to congestion of the 1090 MHz frequency, FIS-B is only provided at 978 MHz.

BRIEF DESCRIPTION OF THE DRAWINGS

Embodiments are described in detail hereinafter with reference to the accompanying figures, in which.

DETAILED DESCRIPTION

Figure 1:
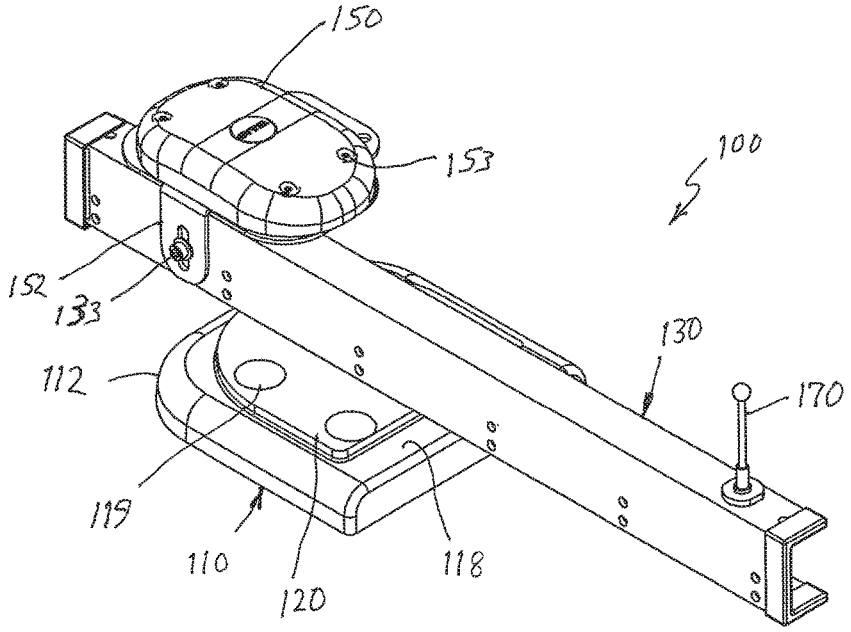
FIG. 1 is a perspective view of the upper left side of a quick mount detachable antenna and mount system according to an embodiment, showing a quick-mount base for removable attachment to a ground support vehicle or the like, a beam carried by the quick-mount base, and a global positioning system receiver antenna and a 1090 MHz transponder antenna carried by the beam.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "left," "right," "front," "back," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

Large airports, particularly class B airports, are complex systems in which many ground support vehicles must operate. A ground-based ADS-B transmitter or transceiver may be provided on service vehicles that operate in aircraft movement area of airports to help eliminate runway incursions and taxiway interference of ground support vehicles with aircraft. Because of capital costs, it may be desirable to provide a fleet of vehicles with a fewer number of portable ground ADS-B systems, which may be transferred between vehicles as appropriate. The present disclosure describes a quick mount detachable antenna and mount system for use with portable ADS-B systems for ground support vehicles.

Figure 2:
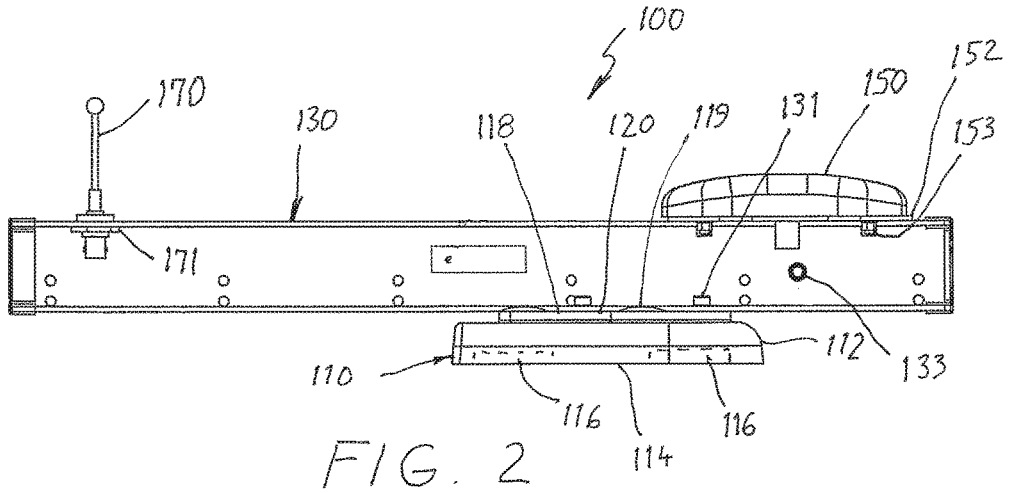
FIG. 2 is an elevation view of the right side of the quick mount detachable antenna and mount system of FIG. 1.
Figure 3:
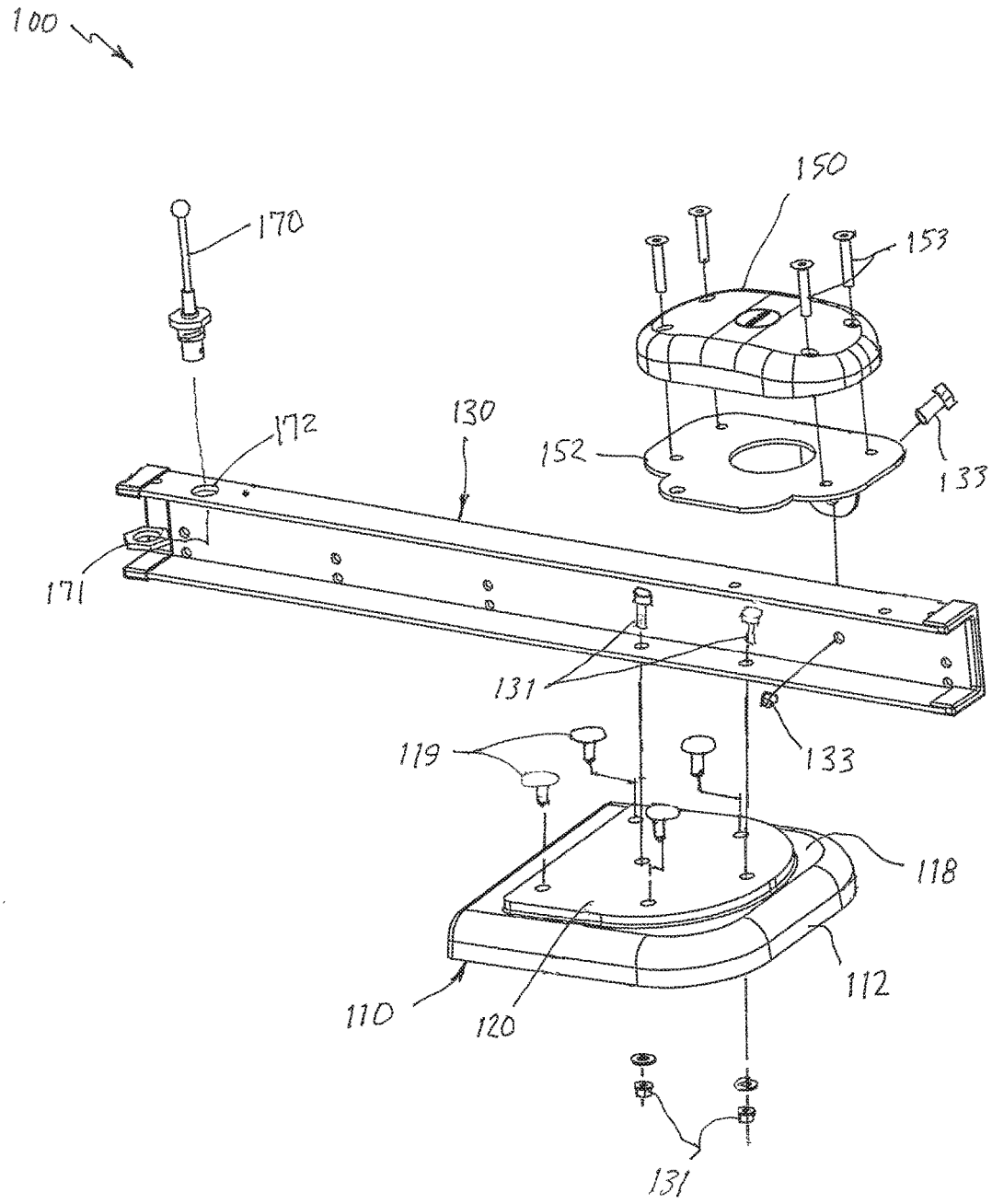
FIG. 3 is an exploded perspective view of the right side of the quick mount detachable antenna and mount system of FIG. 1.

FIGS. 1-3 illustrate a quick mount detachable antenna and mount system 100 according to one or more embodiments. Referring to FIGS. 1-3, quick mount detachable antenna and mount system 100 may include a base 110 for mounting atop a vehicle (not illustrated), for example. Base 110 may have a rounded forward end 112 to minimize aerodynamic drag. Base 110 may be manufactured using a variety of materials and processes. For example, base 110 may be a molded polymer, stamped aluminum, or the like. However, any suitable material and/or manufacturing technique may be used.

The top 118 of base 110 may include a mounting plate 120 arranged for carrying a beam 130. In an embodiment, mounting plate 120 may be made of steel or other ferromagnetic material. Mounting plate 120 may be affixed to base 110 with fasteners 119. Beam 130 may be mounted atop mounting plate 120 so as to be longitudinally aligned with the forward 112 and rear ends of base 110 to minimize aerodynamic drag and yaw forces as the vehicle (not illustrated) is moving. Beam 130 may be mounted to plate 120 using fasteners 131, for example. In an embodiment, beam 130 may be a U-shaped channel, although other profiles may be used as appropriate.

In an embodiment, beam 130 carries a GPS receiver antenna 150 and a 978 MHz or 1090 MHz (L-band) ¼ wavelength monopole ADS-B antenna 170. Beam 130 may have a longitudinal length to provide a distance sufficient to minimize electromagnetic coupling of antennas 150 and 170. GPS receiver antenna 150 may be mounted to a bracket 152 with fasteners 153, which in turn may be mounted to beam 130 via fasteners 133. Bracket 152 may be made of a ferromagnetic material such as steel, which may be electrically coupled to beam 130, so as to provide an adequate ground plane for operation of GPS antenna 150. ADS-B antenna 170 may be directly mounted within an aperture 172 formed through beam 130 using fastener 171.

In an embodiment, the bottom 114 of base 110 may include one or more magnets 116. Magnets 116 may be used to removably attach base 110 to an upper ferromagnetic surface of a vehicle (not illustrated). In other embodiments, the bottom 114 of base 110 may include suction cups (not illustrated), for attachment to the vehicle, or base may be mounted using a tie-down strap (not illustrated) or other temporary or more permanent fasteners, for example. Antennas 150, 170 may be connected to ADS-B transceiver equipment located within the vehicle by coaxial cables (not illustrated). In yet another embodiment, an ADS-B transceiver (not illustrated) may be included in base 110, which may be controlled from within the vehicle by a Bluetooth radio link or the like.

Figure 4:
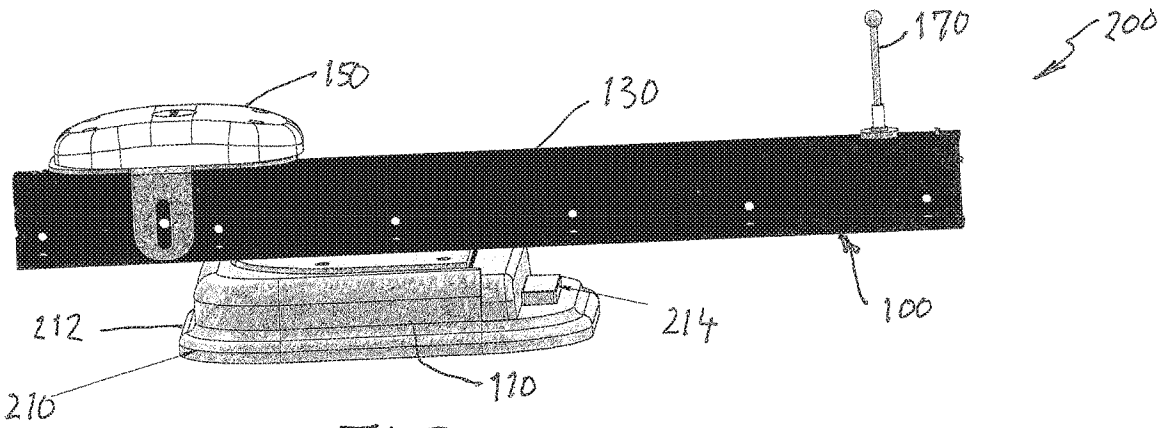
FIG. 4 is a perspective view of the of the left side of a quick mount detachable antenna and mount system according to an embodiment, showing a base in cradle system.
Figure 5:
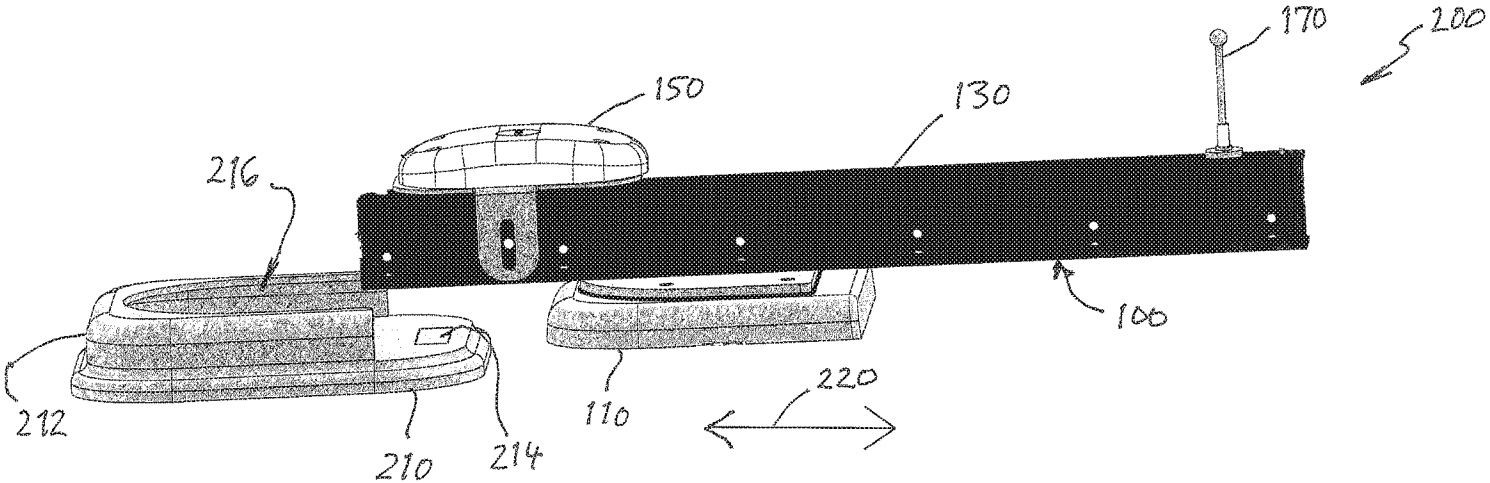
FIG. 5 is an exploded perspective view of the left side of the quick mount detachable antenna and mount system of FIG. 4.

FIGS. 4 and 5 illustrate a quick mount detachable antenna and mount system 200 according to one or more embodiments. System 200 may include quick mount detachable antenna and mount system 100 as described above with respect to FIGS. 1-3 and a cradle 210 which removably receives base 110. Like base 110, cradle 210 may have a rounded forward end 212 to minimize aerodynamic drag. Cradle 210 may be manufactured using a variety of materials and processes. For example, cradle 210 may be a molded polymer, stamped aluminum, or the like. However, any suitable material and/or manufacturing technique may be used.

In an embodiment, the bottom 214 of cradle 210 may include one or more magnets (not illustrated), which may be used to removably attach cradle 210 to an upper ferromagnetic surface of a vehicle (not illustrated). In other embodiments, the bottom 214 of cradle 210 may include suction cups (not illustrated), for attachment to the vehicle, or base 110 may be mounted using a tie-down strap (not illustrated) or other temporary or more permanent fasteners, for example. In yet another embodiment, an ADS-B transceiver (not illustrated) may be included in cradle 210, which may be connected to antennas 150, 170 via coaxial cables (not illustrated) and controlled from within the vehicle by a Bluetooth radio link or the like.

Cradle 210 may include a recess 216 into which base 110 may be received, such as by sliding. A spring loaded detent 214 may be provided in cradle 210 to removable secure base 110 within recess 216. Detent 214 may be depressed to allow base 110 to be slid in or out of recess 216, as indicated by arrow 220.

Various embodiments may include methods of use for base 110 and cradle 210. In one exemplary embodiment, a human operator, such as a driver of a vehicle or a vehicle fleet crewmember may determine that it is appropriate to mount a quick mount antenna system, such as system 100 or 200, to a vehicle. The vehicle may include any of a variety of vehicles, such as a truck, a car, or specialized airport equipment, e.g., a towing vehicle, a luggage retrieving vehicle, fueling vehicle, deicing vehicle, fire truck, or a snowplow. The scope of embodiments is not limited to any particular ground-moving vehicle. In fact, systems 100, 200 may be used as appropriate on any vehicle where ADS-B or other radio communications are desired.

The human operator may determine that it is appropriate to mount system 100, 200 to a vehicle by, for example determining that the vehicle will be moving about in an area in which radio communications are required or desirable. For instance, in a fleet of vehicles, some may be parked or garaged for an extended period of time and, therefore, do not require the use of ADS-B. Other vehicles may be used in the vicinity of a terminal but simply do not operate in taxiways or cross runways, and accordingly may not require the use of ADS-B. However, out of a fleet of vehicles, one or more particular vehicles may be subject to a requirement for ADS-B. Accordingly, the human user may determine that such vehicles should have mounted antenna systems, such as antenna system 100 or 200.

The human operator may then mount antenna system 100 to the top of the vehicle (such as the roof of a cab of the vehicle) such that the longitudinal dimension of beam 130 may be aligned with the longitudinal dimension of the vehicle. Mounting the antenna system 100 may include using attractive force of magnet 116 in base 110 to quickly and removably adhere the antenna system to the vehicle. In another example, the human operator may use another mounting technique, such as a tie-down strap (not shown) that affixes the system to the top of the vehicle. The tie down strap may extend across a lateral dimension of the vehicle and attach to various suitable tie down points.

Alternatively, antenna system 200 with cradle 210 may be used. For instance, the human operator may first affix cradle 210 to the vehicle, using for example, magnets or a tie-down strap. The operator may then slide base 110 into recess 216 until base 110 is held firmly within recess 216. In this example, both cradle 210 and base 110 may be oriented so that the longitudinal dimension of beam 130 is aligned with the longitudinal dimension (and expected direction of movement) of the vehicle.

In other embodiments, each vehicle in a fleet expected to possibly require ADS-B may have cradle 210 semi-permanently affixed to the top of the vehicle, such as by bolts, screws, or adhesive. Then, the operator may simply slide base 110 into recess 216 when needed.

Regardless of how antenna system 100 or 200 is mechanically attached to a vehicle, the human operator may then electrically couple antennas 150 and 170 to an ADS-B transceiver or other electronic device. For example, the coupling may be quickly made using bayonet or threaded Neill-Concelman (BNC, TNC) coaxial connectors or the like. Thus, in one example, one or more electrical cables may extend from antennas 150 and 170 and be directed into an transceiver within the vehicle, through an open window or dedicated opening. In another example, the transceiver may be included as part of the antenna system on top of the vehicle, and communication from the transceiver to the human operator within the cab may be performed wirelessly by, for example, Bluetooth. For example, the operator may use an electronic tablet, iPad, or similar device for wirelessly controlling and communicating with a transceiver mounted with quick mount antenna system 100 or 200. However, the scope of embodiments is not limited to any particular technique for providing a connection between a transceiver and one or more antennas 150 and 170.

The human operator may then operate the vehicle, while an ADS-B transceiver with GPS receiver receives accurate GPS location information via antenna 150 and transmits position messages to aircraft and/or a ground station via antenna 170, thus enhancing ground control operations and minimizing the chance of collision between aircraft and ground vehicles.

The method may further include the human operator determining that antenna system 100 or 200 may be removed from the vehicle. For example, the vehicle may be parked or garaged for an extended period of time such that ADS-B capability is not needed or desired for a period of time. The human operator may then detach antenna system 100 or 200 from the vehicle by removing cradle 210 and/or by removing base 110. In some examples, the human operator may leave cradle 210 mounted to the vehicle while sliding base 110 from recess, thereby removing base 110 to unmount the antenna system. An mounting antenna system 100 may further include uncoupling antennas 150 and 170 from a transceiver. At another time, the human operator may remount antenna system 100 to the same vehicle or another vehicle using a technique the same as or similar to the one described above.

The scope of embodiments is not limited to the particular method described above. Other embodiments may add, omit, rearrange, or modify one or more actions. For example, a user may choose to mount an antenna system to a vehicle and leave it there for such a time that it is effectively a permanent mounting. Also, the example above refers to a human operator, though the scope of embodiments includes scenarios in which the various actions may be performed by different human users, machines, and/or a combination of humans and machines.

While various embodiments have been illustrated in detail, the disclosure is not limited to the embodiments shown. Modifications and adaptations of the above embodiments may occur to those skilled in the art. Such modifications and adaptations are in the spirit and scope of the invention.

What is claimed:

1. An antenna system, comprising:

a base having a first longitudinal dimension, a forward end, and a rear end, wherein the first longitudinal dimension is aligned with an expected direction of movement of the antenna system, and wherein the forward end is rounded to reduce aerodynamic drag on the base;

a beam carried by said base, the beam having a second longitudinal dimension that is longer than the first longitudinal dimension, the second longitudinal dimension aligned with the first longitudinal dimension;

a global positioning system (GPS) antenna carried near a first end of said beam; and a monopole antenna carried near a second end of said beam, wherein the GPS antenna is separated from the monopole antenna by a longitudinal distance to minimize an electromagnetic coupling between the GPS antenna and the monopole antenna.

2. The antenna system of claim 1 further comprising:

a cradle dimensioned and structured for removably receiving said base.

3. A quick-mount ADS-B system, comprising:

a base removably carried by a vehicle, wherein the base has a first longitudinal dimension, a forward end, and a rear end, wherein the first longitudinal dimension is aligned with an expected direction of movement of the vehicle, and wherein the forward end is rounded to reduce aerodynamic drag on the base, the base including;

a beam carried by said base, wherein the beam has an elongate lateral opening and a second longitudinal dimension, the second longitudinal dimension aligned with the first longitudinal dimension;

a global positioning system (GPS) antenna carried near a first end of said beam;

a monopole antenna carried near a second end of said beam; and an ADS-B transceiver electrically coupled to said monopole antenna, wherein the elongate lateral opening of the beam exposes a connector that couples to the monopole antenna to electrically couple at least one of the GPS antenna and the monopole antenna to the ADS-B transceiver after the base is attached to the vehicle, a GPS receiver electrically coupled to said GPS antenna, said GPS receiver operably coupled with said ADS-B transceiver, and the GPS antenna is separated from the monopole antenna by a longitudinal distance to minimize an electromagnetic coupling between the GPS antenna and the monopole antenna.

4. A method for enhancing safety, comprising:

attaching a cradle to a top of a vehicle, the cradle having a rounded forward end to reduce aerodynamic drag;

removably receiving a base, wherein the base has a first longitudinal dimension, wherein the first longitudinal dimension is aligned with an expected direction of movement of the base, wherein a beam is carried by the base, wherein the beam has a second longitudinal dimension greater than the first longitudinal dimension, wherein the second longitudinal dimension is aligned with the first longitudinal dimension, and wherein the beam has a monopole antenna and a global positioning system (GPS) antenna to the cradle attached to the top of the vehicle, the GPS antenna being separated from the monopole antenna by a longitudinal distance to minimize an electromagnetic coupling between the GPS antenna and the monopole antenna;

electrically coupling said GPS antenna to a GPS receiver;

electrically coupling said monopole antenna to an ADS-B transceiver; and operating said vehicle in a vicinity of an airport while receiving location information by said GPS receiver and transmitting position information by said ADS-B transceiver.

5. The antenna system of claim 1, wherein the beam has an elongate lateral opening that exposes a connector that couples to the monopole antenna.

6. The antenna system of claim 2, wherein the cradle includes a rear end and a rounded forward end.

7. The antenna system of claim 1, wherein the base includes one or more magnets disposed in a bottom of the base.

* * * * *